US006739819B2

(12) United States Patent
Caudill et al.

(10) Patent No.: US 6,739,819 B2
(45) Date of Patent: May 25, 2004

(54) DRYWALL / PANELING LIFT

(76) Inventors: Avery Chester Caudill, 260 Airport Rd., North Wilkesboro, NC (US) 28659-9370; Lynne Ann Caudill, 260 Airport Rd., North Wilkesboro, NC (US) 28659

( * ) Notice: Subject to any disclaimer, the term of this patent is extended or adjusted under 35 U.S.C. 154(b) by 31 days.

(21) Appl. No.: 10/107,186

(22) Filed: Mar. 28, 2002

(65) Prior Publication Data

US 2003/0194295 A1 Oct. 16, 2003

(51) Int. Cl.[7] ..... E04G 21/16
(52) U.S. Cl. ..... 414/11; 254/4 R
(58) Field of Search ..... 414/11, 540; 254/4 R, 254/387

(56) References Cited

U.S. PATENT DOCUMENTS 2,899,084 A * 8/1959 Brunnemer et al. ..... 414/11 X
2,939,590 A * 6/1960 Henry ..... 414/11
3,382,988 A * 5/1968 O'Reilly ..... 414/11
3,923,167 A * 12/1975 Blgnkenbeckler ..... 414/11
4,023,686 A * 5/1977 Papsco et al. ..... 414/11
4,117,939 A * 10/1978 Haddock ..... 414/11
4,150,755 A * 4/1979 Trott et al. ..... 414/11
4,175,899 A * 11/1979 Tipton ..... 414/11
5,984,605 A * 11/1999 Young ..... 414/11

* cited by examiner

*Primary Examiner*—Janice L. Krizek

(57) ABSTRACT

It is a light weight device that can be disasembled in a very short time to allow a person to move it from one floor to another. The platform can be used as a dolly when not being use as a lift or a work bench to hold screw gun and supplies when using as a lift. It saves the overhead of extra manpower by enabeling one man to raise the material all the way from the floor to the ceiling and hold it in place. Anyone can use it, no technical skills required. If desired the winch can be replaced with a motorized winch.

1 Claim, 5 Drawing Sheets

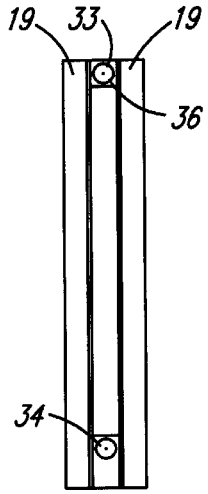
Fig. 8
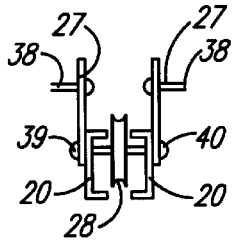
Fig. 19
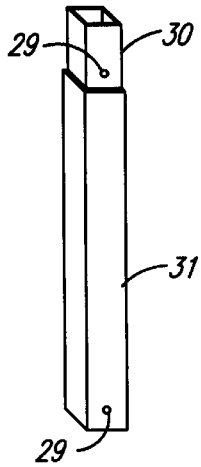
Fig. 9
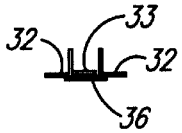
Fig. 6
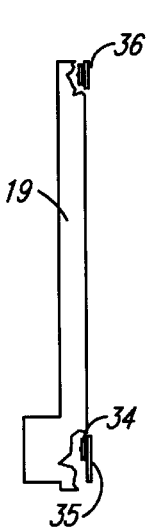
Fig. 7
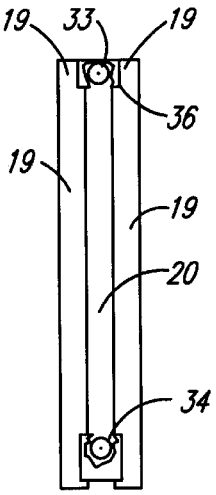
Fig. 5
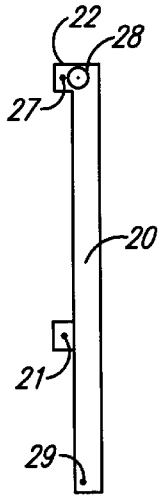
Fig. 2
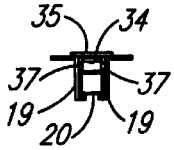
Fig. 4
Fig. 3
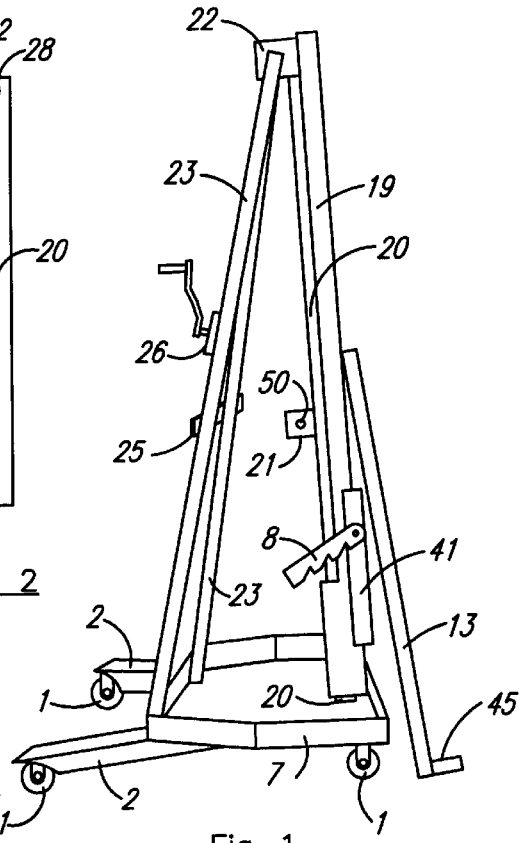
Fig. 1

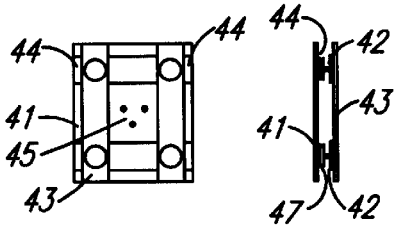
Fig. 12
Fig. 13
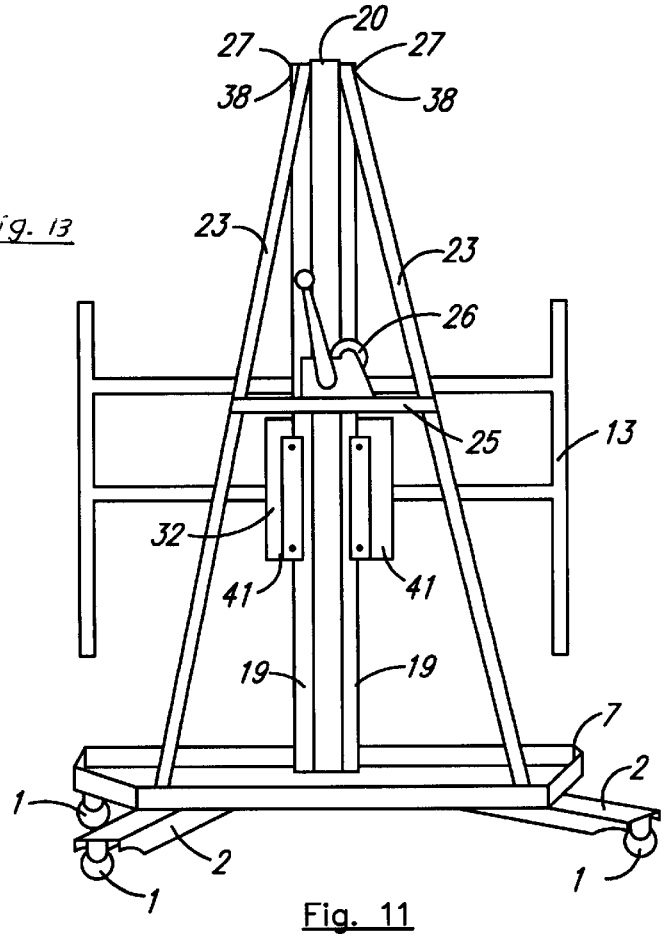
Fig. 11
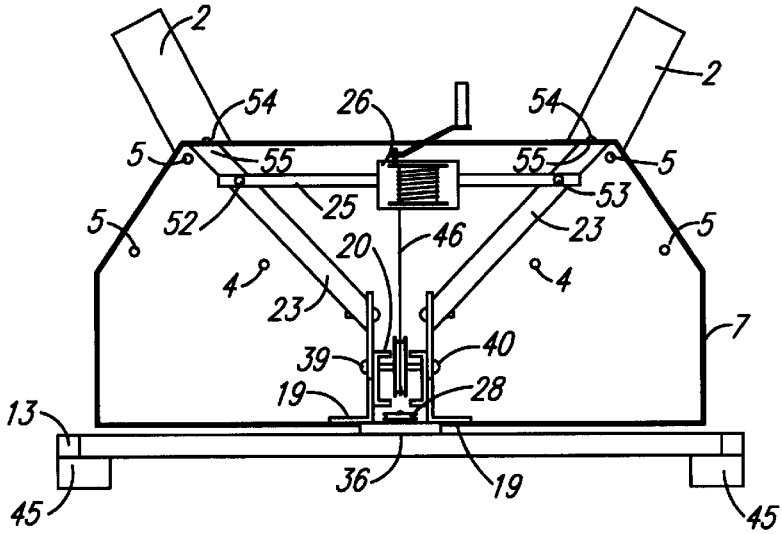
Fig. 10

DRYWALL / PANELING LIFT

CROSS REFERENCE TO RELATED APPLICATIONS

| Patent No. | Inventor | Dates |
|---|---|---|
| 2,815,132 | Stone | Dec. 3, 1957 |
| 2,939,590 | Henry | Jun. 7, 1960 |
| 3,058,602 | Kilman | Oct. 16, 1962 |
| 3,221,900 | Love | Dec. 7, 1965 |
| 3,314,553 | Vircks | Apr. 18, 1967 |
| 3,382,988 | O'Rielly | May 14, 1968 |
| 3,394,778 | Brinton | Jul. 30, 1968 |
| 3,828,924 | Perkins | Aug. 13, 1974 |
| 3,871,477 | Kuest | Mar. 18, 1975 |
| 4,369,014 | Jolivet | Jan. 18, 1983 |
| 4,508,316 | Millard | Apr. 2, 1985 |
| 4,630,383 | Gamm | Dec. 23, 1986 |
| 4,682,926 | Chambers et al. | Jul. 28, 1987 |
| 4,810,151 | Shern | Mar. 7, 1989 |
| 4,876,789 | Burell | Oct. 31, 1989 |
| 4,944,366 | Pryor et al. | Jul. 31, 1990 |
| 5,259,721 | Sato et al. | Nov. 9, 1993 |
| 5,368,429 | Young | Nov. 29, 1994 |
| 5,586,619 | Young | Dec. 24, 1996 |
| 5,700,123 | Rokosh et al. | Dec. 23, 1997 |
| 5,839,876 | McCarthy et al. | Nov. 24, 1998 |
| 5,918,861 | Parker | Jul. 6, 1999 |
| 6,050,548 | Leger | Apr. 18, 2000 |

| Foreign Patent No. | Country & Dates |
|---|---|
| 0 115 370 A2 | Europe, August 1984 |
| DE 36 24 309 A1 | Germany, January 1988 |
| 1-192955 | Japan, August 1989 |
| 5-178429 | Japan, July 1993 |

BACKGROUND OF INVENTION

The devise as a lift can be used in the building industry during new or remolding construction. The platform can be used as a dolly anytime.

BRIEF SUMMARY OF INVENTION

The invention described is related generally to material handling devises. More specifically, the invention is a lift to assist a person who is installing drywall or paneling to a wall or ceiling. The device is configured to fit through a 24" door with drywall or paneling on it. It has a platform for holding material. The device can hold up to 150 LBS of material, and the telecopic column can extend 10 feet. By adding the extension to the inside column will allow the material to go higher than 10 feet. The device is also equipped with extensible legs, a winch or motor, pulleys, guides, rollers, spacers, hinges, stop bars, braces, locking mechanisms, a swivel point, and a rack. The device is easily broken down within a very short period of time allowing it to be moved from floor to floor. The platform can be used separately as a dolly. The devise allows one man to take a piece of material from the floor to the ceiling by himself and hold it in place while he fastens it to the ceiling.

BRIEF DESCRIPTION OF THE DRAWINGS

Figure 16:
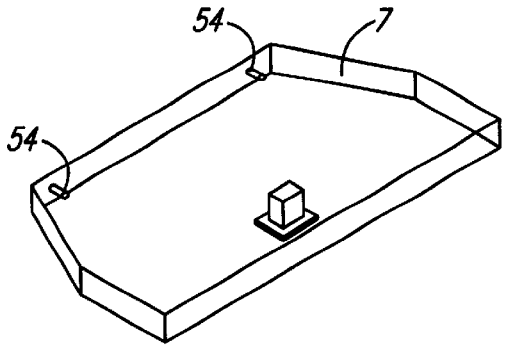
Figure 15:
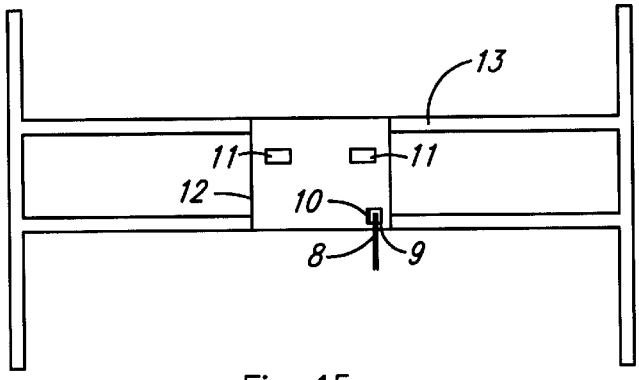
Figure 20:
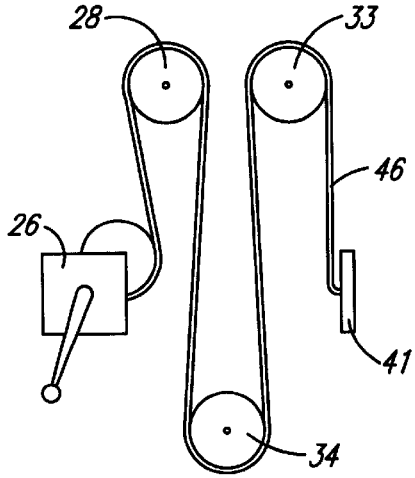
Figure 14:
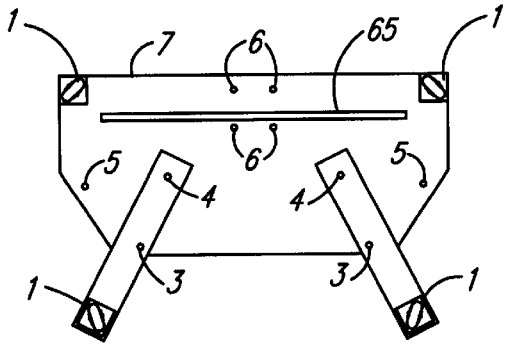
Figure 17:
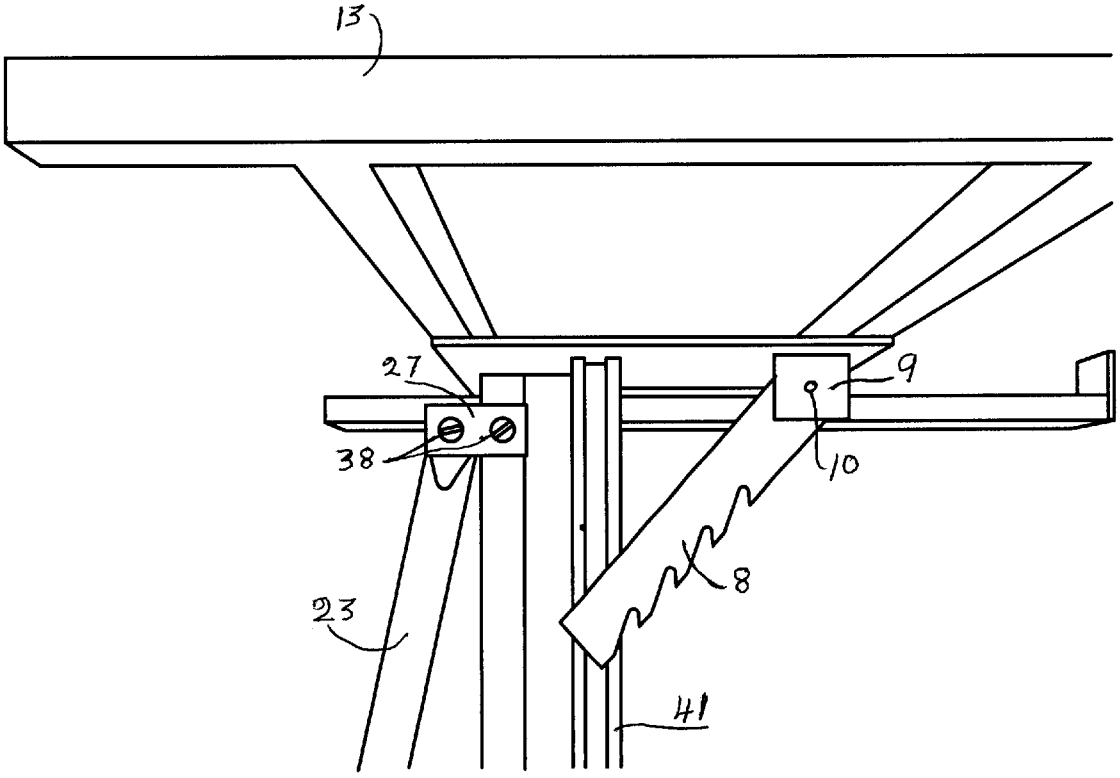
Figure 18:
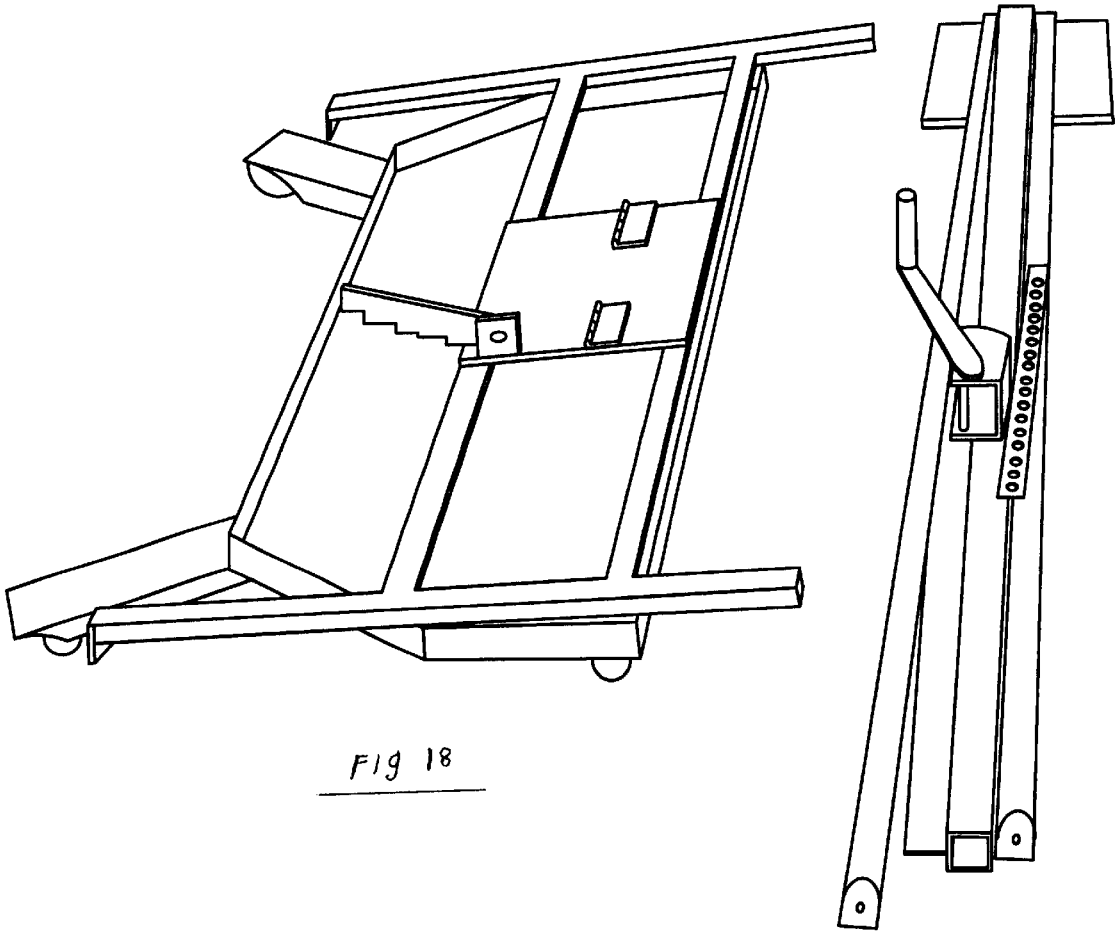

| | |
|---|---|
| FIG. 1 | Side View of Unit |
| FIG. 2 | Side View of Inside Column |
| FIG. 3 | Bottom View of Inside Column |
| FIG. 4 | Bottom View of Outside Column |
| FIG. 5 | Front View of Outside Column |
| FIG. 6 | Top View of Outside Column |
| FIG. 7 | Side View of Outside Column |
| FIG. 8 | Back View of Outside Column w/ relationship to Inside Column |
| FIG. 9 | Extension for the Inside Column |
| FIG. 10 | Top View of Unit |
| FIG. 11 | Back View of Unit |
| FIG. 12 | View of Slide Bar |
| FIG. 13 | Side View of Slide Bar |
| FIG. 14 | Bottom View of Unit |
| FIG. 15 | Back View of Material Rack |
| FIG. 16 | Stationary Bracket |
| FIG. 17 | Side View of Latching Bracket & Top of Unit |
| FIG. 18 | Unit Disassembled into Three Sections |
| FIG. 19 | Top View of Inside Column |
| FIG. 20 | Cable Rigging |

DETAILED DESCRIPTION

FIG. 1, 1—Dolly Wheels

2—Extendable Legs—These will swing into position to go through a 2 foot door or swing outwards to allow the unit to elevate to a higher position.

7—Platform—Base of unit can also be used as a dolly to haul material with or without the lift.

8—Latching Bar—allows you to Lock the material rack into different degree of angles.

13—Shows the position of the material rack at floor level

19—Outside column when unit is at lower level.

20—Inside column with relation to the outside column.

21—Bracket for reinforcement bars FIG. 9 is being used.

22—Bracket for reforcement bars without extension.

23—Reforcement bars.

25—Mounting bridge for winch.

26—Winch which can be replaced with motor.

41—Sliding bar which travels up and down outside column.

45—Feet for holding building boards which is mounted on Item #13.

50—Bold hole for attaching reinforcement bars.

FIG. 2, 20—Side view of inside column with relationship to sheave.

21—Bracket for reinforcement bars FIG. 9 is being used.

22—Bracket for reforcement bars without extension.

27—Bold stud for reinforcement brackets.

28—Top sheave on inside column.

29—Pin hole to hold inside columb to Item #20.

FIG. 3, Bottom view of Item #20.

FIG. 4, 19—Top view of the unit in relation to item #20.

20—Inside column with relation to the outside column.

34—Top sheave on the outside column mounted on item #35.

35—Bridge tying the two angles together which makes up item #19.

37—Rollers for the outside column.

FIG. 5, Item #19 front view of the outside column which will travel up and down inside column after the slide bar item #41 reaches the stop on top of outside column.

33—Sheave mounted on the top bridging which serves as a stop for the slide bar.

34—Sheave mounted on the bottom bridging of the outside column which is item #19.

FIG. 6, Top View of the outside column showing the sheave #33 and the stop bridging item #36

FIG. 7, Side view of outside column showing the top stop bridging and item #36 sheave and also showes the bottom bridging and item #34 sheave.

FIG. 8, Back view of the outside column which will travel up and down inside column after the slide bar item #41 reaches the stop on top of the outside column.

FIG. 9, Shows the inside extension column, which is an optional attachment for higher elevation and item #30 is the male connection for inside column item #20 and item #29 are the pinholes to hold it together.

FIG. 10, Is a top view of the unit and item #2 Extendable legs. Item #5 is the pin hole to hold the legs in place which allow you to put the legs into different positions for narrower places. Item #46 is a flexible cable which one end is secured to the slide bar item #41. The cable goes through the sheaves and to the drum of the winch. In FIG. #20 shows the rigging of the cable. Item #26 is the winch which is bolted to bracket item #25 which is fastened to the reforcement bars. The bracket will swivel on one side with a removable pin on the other side to make it easy to disasemble. Item #52 is the swival point of the bracket item #25. Item #53 is the removable pin point for bracket item #25. Item #23 are the reforcement bars. Item #54 is the bolt for secureing the reforcement bars item #23 to the base. Item #55 are the wing nuts holding reinforcement bars to item #54 for easy disasemble. Item #4 are the swival points for the legs item #2. item #36 is the bridging stop bar on top of of the outside column item #19. Item #28 is the sheave that is mounted to item #36.

FIG. 11, Back view of the unit item #2 the extendable legs and Item #1 are the dolly wheels. Item #7 which is the base which can be used as a dolly with or without the lift. Item #13 is the material rack which is hinged to the slide bar item #41. Item #25 is the bracket holding the winch. Item #26 is the wench which operates the system and can be replaced with a motor if desired. Item #41 is the slide bar that travels up and down the outside column. Item #43 is the bracket which holds the slide bar in place. Item #27 and Item #38 are the stud bolts holding the reinforcement bars Item #38 are the wing nuts that hold the reinforcement bars in place. Item #32 are the bolts holding the slide bar assembly together (4).

FIG. 12, Is the detail of the slide bar assembly. Item #44 is the spacer that also serves as the stop bar when the slide bar, item #41 reaches the top of the unit. Item #45 are the tie holes for the cable to the slide bar, item #41. Item #43 holds the slide bar in place.

FIG. 13, Is the detailed side view of the slide bar assembly, Item #41. Item #47 is the bottom spacer. Item #42 are the rollers that make it easy to slide up and down the column. Item #44 is the spacer that also serves as the stop bar when the slide bar, item #41 reaches the top of the unit. Item #43 holds the slide bar in place.

FIG. 14, Bottom view of the unit, item #7 is the platform, item #6 are the holes to bolting down item #17 which is the latching brachet. Item #65 is the reinforcement bars mounted on the bottom of the platform for extra strength. Item #1 are the dolly wheels mounted on the bottom of the platform Item #7. Item #2 are the extendable legs with swing in or out depending upon the amount of space available or the height of the column. item #3 is the pin hole which hold the legs, item #2 in place. Item #5 are the pin holes for the legs, item #2.

FIG. 15, Item #13 is the material rack. Item #11 are the hinges which holds the material rack to the slide bar. Item #9 is the bracket holding the latching bar item #8 which allows you to lock the material rack into different degree of angles. Item #10 is the pin which holds Item #8 & Item #9 together. Item #12 is the steel plate which helps make up the material rack.

FIG. 16, Item #17 is the male connection tying the platform and the column together. Item #7 is the platform. Item #18 is the pin holes which are used to secure column item #20 to the male connection item #17.

FIG. 17, Side view of the latching bar holding the material rack, item #13 in a flat ceiling position. Item #8 is the latching bar which shows several notched positions for different ceiling slopes. Item #9 is the bracket holding the latching bar item #8 which allows you to lock the material rack into different degree of angles. Item #10 is the pin which holds Item #8 & Item #9 together. Item #41 is the slide bar which shows the relation to the latching bar. Item #23 are the reforcement bars. Item #38 are the wing nuts that hold the reinforcement bars on the stud bolts, item #27. Which make is easy to disasemble.

FIG. 18, Shows the Unit disasembled into three sections. The unit can be broken down in a very short time by removing two wing nuts and loosing two other wing nuts and removing two pins.

FIG. 19, Is the top view of the inside column which is item #20. Item #28 is the top sheave on the top inside column. Item #40 is the bolt holding the sheave in place and item #39 is the nut holding the bolt in place. Stud bolt holding reinforcement bars item #27 and item #38 are the wing nuts that hold the reinforcement bars in place. Which make is easy to disasemble.

FIG. 20, Shows the rigging of the flexable cable, item #46 goes from the winch, item #26 then thread through the top of sheave, item #28 down through the the lower sheave item #34 then to the top sheave item #33 and then down to the slide bar, item #41.

What is claimed is:

1. A device for lifting and tilting a panel of material, the device comprising:

a platform (7) having top and bottom surfaces, the platform including a plurality of wheels (1) mounted on the bottom surface;

a pair of legs (2) pivotally attached to the bottom surface of said platform, each of the legs having at least one wheel (1) mounted thereon;

a column assembly (19, 20) mounted on the top surface of said platform and extending uprightly relative to the top surface of said platform;

a bar structure (23, 25) interconnecting the top surface of said platform and said column assembly, said bar structure supporting a winch (26);

a material rack (13) mounted on said column assembly for vertical movement along said column assembly and for tilting relative to said column assembly; and a cable and sheave assembly (28, 33, 34, 46) operably interposed between said material rack and said winch for vertically moving said material rack along said column assembly.

* * * * *